United States Patent [19]

Caras et al.

[11] 4,091,304

[45] May 23, 1978

[54] GAS DISCHARGE DISPLAY PANEL WITH MERCURY CAPSULE DISPOSED IN CHANNELED INSULATING SHEET

[75] Inventors: Bernard Caras, Princeton; Stacy W. Hall, Fanwood, both of N.J.

[73] Assignee: Burroughs Corporation, Detroit, Mich.

[21] Appl. No.: 743,506

[22] Filed: Nov. 19, 1976

[51] Int. Cl.[2] ..... H01J 61/20; H01J 61/30

[52] U.S. Cl. ..... 313/174; 313/177; 313/188; 313/220

[58] Field of Search ..... 313/174, 220, 177, 188

[56] References Cited

U.S. PATENT DOCUMENTS

| | | | |
|---|---|---|---|
| 3,704,386 | 11/1972 | Cola | 313/188 X |
| 3,862,447 | 1/1975 | DeVries et al. | 313/220 |
| 3,947,713 | 3/1976 | Przybylek | 313/174 |
| 3,995,185 | 11/1976 | Miller | 313/188 X |

*Primary Examiner*—Palmer C. Demeo

*Attorney, Agent, or Firm*—Kevin R. Peterson; Robert A. Green; Edward J. Feeney, Jr.

[57] ABSTRACT

The display panel includes a gas-filled envelope made up of a base plate and a face plate hermetically sealed together. A cell sheet is disposed between the base plate and face plate, an array of cathode strips is disposed between the base plate and cell sheet, and an array of anodes is disposed between the face plate and cell sheet, with the anodes being disposed at an angle to the cathodes so that each crossing of an anode and cathode and the volume of gas between them define a display cell. The cell sheet includes slots which define rows of separate operating areas on each cathode. In addition, each cathode strip defines a column of operating cathode areas. The panel carries a mercury capsule, whether in the tubulation or in a convenient portion of the cell sheet, and the cell sheet is provided with channels or slots, in communication with the mercury capsule, to facilitate the dispersion of mercury throughout the panel.

2 Claims, 5 Drawing Figures

Fig. 2
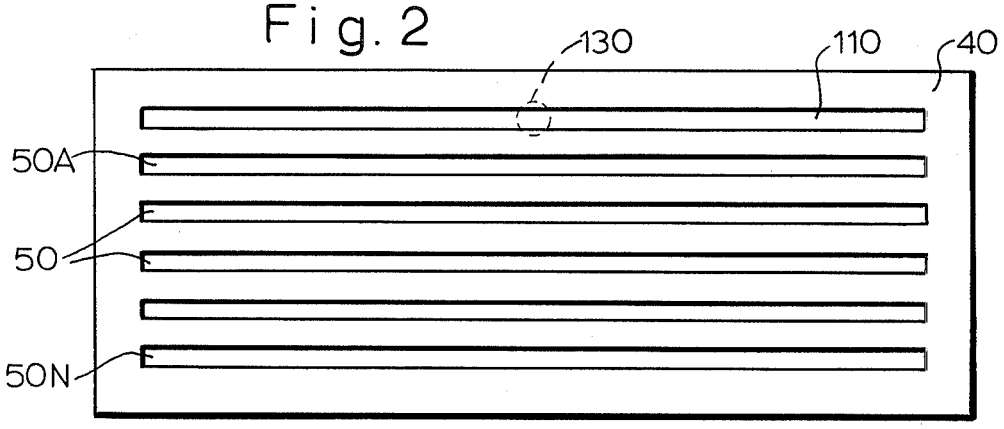
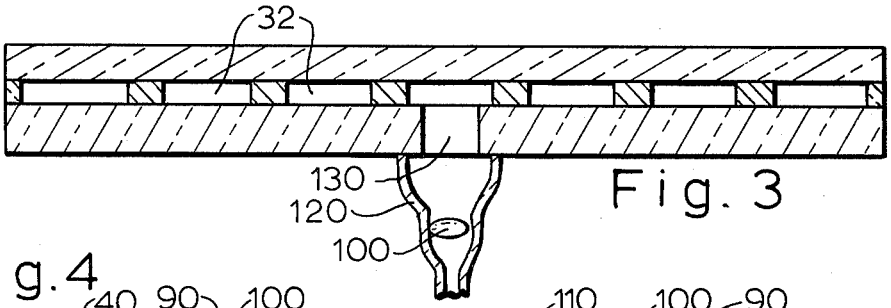
Fig. 3
Fig. 4
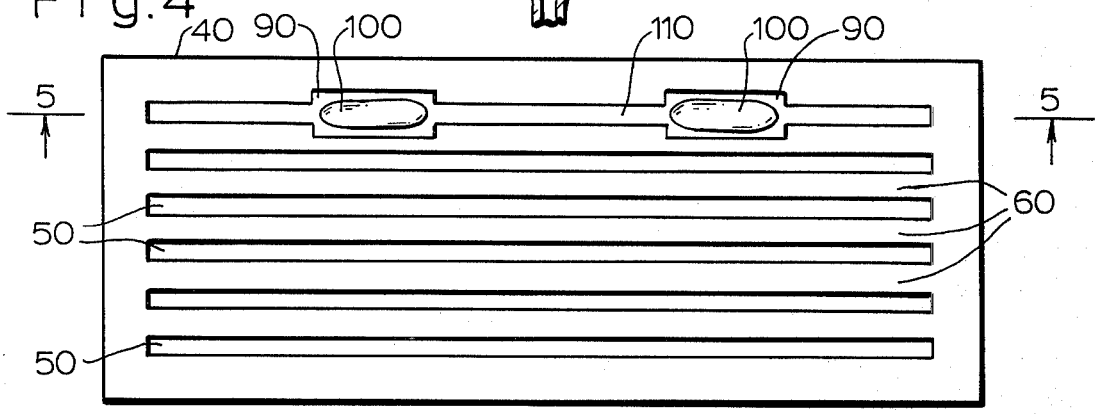
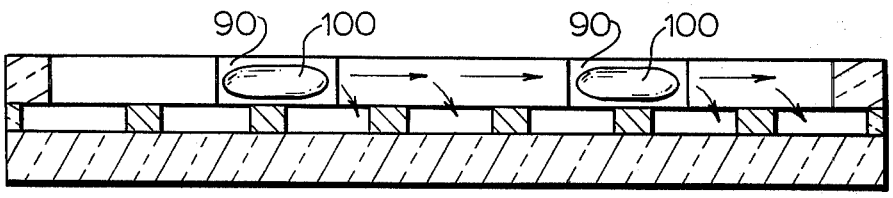
Fig. 5

GAS DISCHARGE DISPLAY PANEL WITH MERCURY CAPSULE DISPOSED IN CHANNELED INSULATING SHEET

BACKGROUND OF THE INVENTION

Display panels of the type contemplated by the invention are known as SELF-SCAN panels and are described in many patents and copending applications, including Ser. No. 636,919, filed Dec. 2, 1975, now U.S. Pat. No. 3,995,185 and incorporated herein by reference. These devices all include mercury in their gas filling to minimize cathode sputtering. Usually, the mercury is provided in a breakable or openable capsule which is mounted in the panel. At a predetermined time in the manufacturing process, the mercury capsule is opened to release the mercury into the panel. In panels of this type, a problem arises which is related to the optimum location for the mercury capsule and the provision of means for insuring the dispersion of the mercury throughout the panel. The present invention solves this problem by mounting the mercury capsule in operative relation with channels through which the mercury can disperse.

DESCRIPTION OF THE DRAWINGS

FIG. 2 is a plan view of a portion of the panel of FIG. 1;

FIG. 3 is a sectional view, along the lines 3—3 in FIG. 1, showing the panel assemblies;

FIG. 4 is a plan view of a portion of the panel of FIG. 1 showing a modification of the invention; and FIG. 5 is a sectional view, along the lines 5—5, showing a portion of the panel of FIG. 4 along these lines.

DESCRIPTION OF THE PREFERRED EMBODIMENTS

Figure 1:
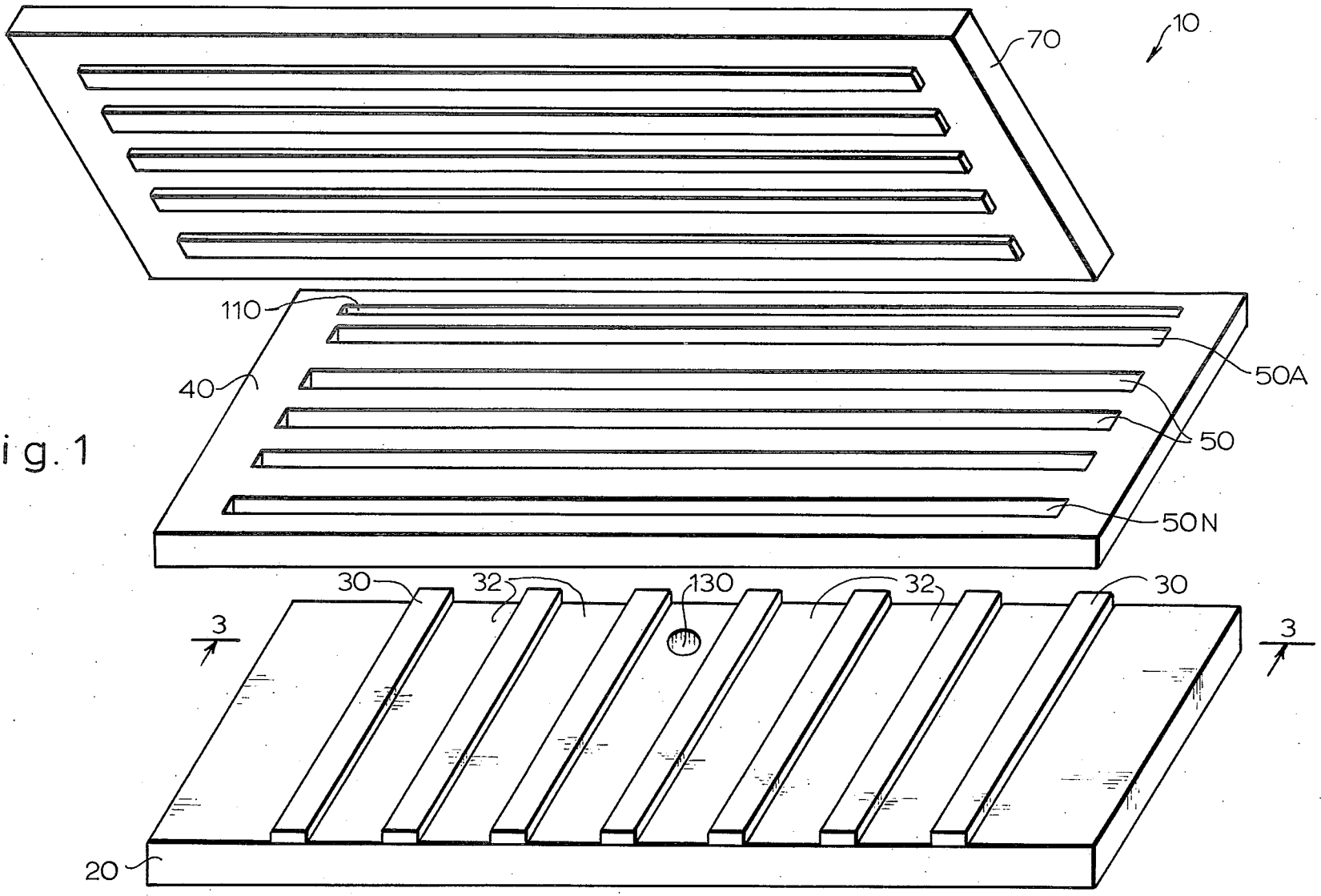
FIG. 1 is a perspective exploded view of a display panel embodying the invention.

The principles of the invention are applicable to many types of display devices, but they are particularly useful in SELF-SCAN panels of the type disclosed in the above-noted copending application Ser. No. 636,919. Briefly, referring to the drawings, this type of panel 10 includes a base plate 20 on which a plurality of conductive cathode strips 30 are formed, preferably by a screening process. The cathodes are divided into individual operating areas by means of a center sheet 40 of an insulating material seated thereon. The center sheet includes an array of a plurality of channels 50 formed by spaced parallel walls 60. The channels are disposed horizontally, and the array includes a top channel 50A, a bottom channel 50N, and a plurality of intermediate channels, as required by the selected dot matrix used for displaying characters. The sheet 40 is seated on the cathodes 30 so that the channels 50 overlie rows of cathode areas. Each individual cathode area formed by the center sheet defines, with other electrodes to be described, an operating glow discharge cell, there being rows and columns of such cathode area and such cells. The panel 10 is completed by an anode plate 70 which is the face plate or viewing plate of the panel and which carries, on its inner surface, a separate conductive transparent anode strip 80 overlying each of the channels 50 in the center sheet and each of the rows of individual cathode areas defined by the channels in the center sheet.

The panel 10 includes a tubulation 120 (FIG. 3) which is hermetically sealed to the base plate 20 in alignment with a hole 130 in the base plate. A mercury capsule 100 is held within the tubulation, as is well known in the art and as shown in U.S. Pat. No. 3,947,713. The parts described up to this point are found in the prior art. As can be seen in FIG. 1, the hole 130 is disposed between two cathode strips 30, and mercury is expected to diffuse throughout the panel from this single hole 130. It can be seen that lateral diffusion is difficult and slow because of the presence of the cathode strips and because of the small spacings between the various parts of the panel.

According to the invention, as seen in FIGS. 1 and 2, the cell sheet 40 is provided with an auxiliary gas diffusion channel 110, which is parallel to the channels 50, which define the rows of cathode operating areas. The auxiliary channel 110 overlies the tubulation 120 and hole 130, and these three structural elements are disposed adjacent to, but spaced from, the upper channel 50A and out of the viewing area of the panel. With this arrangement, when the mercury capsule is opened, the mercury vapor diffuses from the tubulation 120, through the hole 130 in the base plate, and laterally along the diffusion channel 110, thence vertically along all of the spaces 32 between the cathodes 30 and horizontally along all of the channels 50 to fill the panel, as required. This mercury diffusion takes place rapidly.

In a modification of the invention illustrated in FIGS. 4 and 5, the tubulation 120 and hole 130 need not be provided, and the channel 110 in cell sheet 40 is provided with one or more elongated rectangular slots 90, in each of which a mercury capsule 100 is seated. The mercury capsule may be made of glass or metal or the like, as is now well known in the art. As can be seen, the slot 90 is in gas communication with the mercury diffusion channel 110 so that, as described above, when the mercury capsule 100 is opened and mercury is released, it can diffuse horizontally along the channel 110 and then vertically along all of the spaces 32 between the cathodes 30, as can be seen in FIG. 5. Thus, the mercury can rapidly reach all of the display area of the panel more rapidly. It is noted that the channel 110 has a conductance for mercury of three or four times that of the single hole 130.

Modifications may be made in the specific structures described above, and, as an example, more than one channel 100 and mercury capsule 90 might be required in practicing the invention. In addition, if desired for some reason, channels 100 containing mercury capsules 90 and a tubulation 120 containing a mercury capsule might be used together in a panel.

What is claimed is:

1. A display panel comprising a gas-filled envelope including a base plate and a face plate hermetically sealed together, said face plate having a viewing window, a plurality of cathode strips disposed vertically and parallel to each other on the surface of said base plate in said envelope, anode electrode means in operative relation with said cathode strips, an insulating sheet having a plurality of first horizontal channels defining a display area seated on said cathode strips between said base plate and face plate, there being vertical gas flow paths extending along said cathode strips beneath said insulating sheet, said channels defining rows of operating cathode areas and subdividing said cathode strips into columns of operating cathode areas, an auxiliary channel in said insulating sheet disposed parallel to said first channels, and a source of mercury which comprises a mercury capsule disposed in said auxiliary channel and communicates from said auxiliary channel to said vertical gas flow paths.

2. A display panel comprising a gas-filled envelope including a base plate and a face plate hermetically sealed together, said face plate having a viewing window, a plurality of cathode strips disposed vertically and parallel to each other on the surface of said base plate in said envelope, anode electrode means in operative relation with said cathode strips, an insulating sheet having a plurality of first horizontal channels defining a display area seated on said cathode strips between said base plate and face plate, there being vertical gas flow paths extending along said cathode strips beneath said insulating sheet, said channels defining rows of operating cathode areas and subdividing said cathode strips into columns of operating cathode areas, an auxiliary channel in said insulating sheet disposed parallel to said first channels, and a source of mercury lying in, and thus in communication with, said auxiliary channel and, from said auxiliary channel, with said vertical gas flow paths, said source of mercury comprising a plurality of mercury capsules spaced apart in said auxiliary channel.

* * * * *